United States Patent [19]

Gardner, Jr.

[11] 4,390,118

[45] Jun. 28, 1983

[54] JAM PREVENTION MEANS FOR HIGH-SPEED WEB HANDLING DEVICE

[76] Inventor: Joseph J. Gardner, Jr., 18557 Bowie Mill Rd., Olney, Md. 20832

[21] Appl. No.: 210,189

[22] Filed: Nov. 25, 1980

[51] Int. Cl.[3] ..... B65H 25/00; B65H 7/12

[52] U.S. Cl. ..... 226/25; 271/263

[58] Field of Search ..... 226/48, 5, 25; 271/263, 271/311, 313; 209/584

[56] References Cited

U.S. PATENT DOCUMENTS

| | | | |
|---|---|---|---|
| 2,318,132 | 5/1943 | Welk | 271/263 X |
| 3,176,981 | 4/1965 | Vandeman | 271/263 |
| 3,722,773 | 3/1973 | Geeradus | 271/263 |
| 3,860,234 | 1/1975 | Parenti | 271/263 |
| 4,244,648 | 1/1981 | Schultes | 271/311 |

OTHER PUBLICATIONS

Xerox Disclosure Journal-Volumes, No. Jan./Feb. 1980-Paper Guide/Stripper Fingers, Louis R. Hattler.

*Primary Examiner*—Edward J. McCarthy

*Attorney, Agent, or Firm*—Vito J. DiPetro; Thomas J. Byrnes; A. David Spevack

[57] ABSTRACT

A web handling device, such as a high-speed printing press, is provided with a jam prevention means comprising stripper fingers equipped with a shut down means which prevents damage to the press if a blockage occurs during the stripping operation.

10 Claims, 2 Drawing Figures

FIG. 1
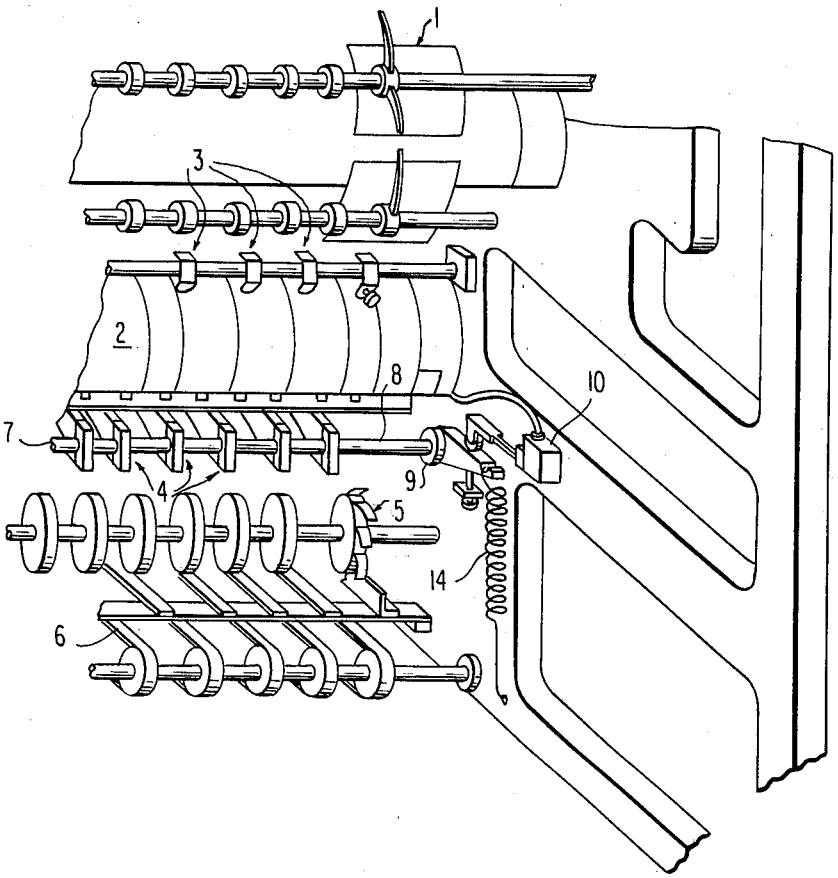
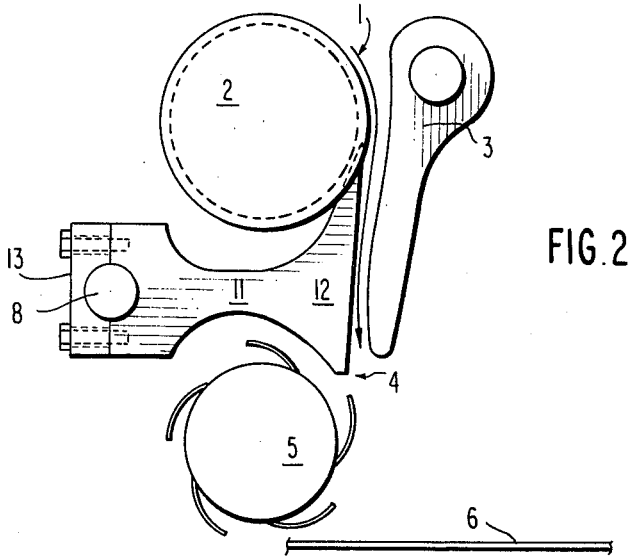
FIG. 2

JAM PREVENTION MEANS FOR HIGH-SPEED WEB HANDLING DEVICE

BACKGROUND OF THE INVENTION

This invention relates to strippers which strip a web material from a conveyor surface in a web handling device. More particularly, the invention relates to a novel arrangement of stripper fingers and a shut down mechanism to produce a jam prevention means whereby damage to the web handling device is eliminated or minimized. The novel combination operates to sense a blockage occurring in the web handling device and shut the device down before any serious damage is done.

The web handling device can be any type of machine which moves a web at high speed, including such devices as xerographic or electrostatic printing machines, cloth handling machines for printing and dying fabrics, high-speed printing presses, or feeders and folding apparatus associated with such web handling devices. The invention is most preferably used with a high-speed printing press.

The web may be any cellulosic, plastic, or other material which can be formed into a sheet, ribbon, or roll, such as natural or man-made fabrics, thin plastic films, or paper. The web may be either in the form of a continuous ribbon, discontinuous sheets, or combinations of either of these such as bandage rolls, signatures consisting of a number of folder sheets or a bundle of sheets.

Web handling devices perform a number of operations which require a web to be stripped from a conveyor surface such as a plate or drum by stripper fingers. The fingers help to remove the web from one surface and guide it to the next station in the web handling device.

The stripper fingers used to strip a web may be of the stationary type or the moving type. Stationary stripper fingers are passive and accomplish the stripping operation by deflecting the web in a desired direction. They may operate in any one of a number of locations, including grooves in the conveyor surface, level with the conveyor surface, or raised less than a web thickness above the conveyor surface. Stationary type stripper fingers are illustrated in U.S. Pat. No. 3,992,000 to Martin or U.S. Pat. No. 4,156,524 to Ari bar-On. In contrast, the moving stripper fingers use a controlled or timed movement to flip the web from one conveyor surface to another. Moving type stripper fingers are illustrated in U.S. Pat. No. 3,450,402 to Weiler, U.S. Pat. No. 3,578,859 to Stillings, or U.S. Pat. No. 4,004,802 to Brooke.

Occasionally, the web fails to be properly guided from the conveyor surface by the stripper fingers and a blockage is created which causes the web to jam. This jam can be destructive to the web handling device as well as causing a loss of operating time. This is particularly true in large high-speed presses where jams can develop in the associated folding apparatus such as that described in U.S. Pat. No. 966,095 to Hollingsworth, U.S. Pat. No. 1,784,757 to Scott, or U.S. Pat. No. 3,717,337 to McCain et al. Since the high-speed press and any associated equipment is operating at very high speeds, any jam in the web flow will cause a large volume of such material to be jammed into a small area before an operator can manually shut down the press. Such a jam not only causes a loss of valuable web material but also requires considerable time and effort to undo. Such a jam can commonly be so tight that crow bars and extensive equipment disassembly are required to undo the jam. Such a disassembly operation causes a loss of time and delays completion of the job. Very often the stripper fingers, guides, and other parts of the press are broken or bent by the jam causing increased expenses for parts.

In some office xerographic copying machines, the paper flow is controlled by complex electric eyes or optical devices counting the passing sheets or pressure switches which are struck by an out of place sheet. These mechanism are impractical for high-speed, heavy duty devices which process the web in the form of a fabric, a signature, a bundle of sheets, or the like. For these devices stripper fingers are preferred because they have the ruggedness and longevity necessary for satisfactory and economical operation of the device.

Therefore, it is the object of this invention to provide a novel arrangement of stripper fingers and a shut down mechanism which will prevent jams. It is another object of this invention to provide a means to shut down the web handling device when blockage of the web occurs so as to eliminate or minimize damage to the web handling device. Further, it is an object of this invention to provide a means to reduce or eliminate damage to stripper fingers, conveyors, or the like in web handling devices. In addition, it is an object of this invention to provide a means to reduce or eliminate lost time resulting from jams at the stripper fingers in web handling devices. Other objects and advantages of the invention will become apparent upon reading the description of the preferred embodiments with reference to the drawings.

SUMMARY OF THE INVENTION

The objects of the invention are accomplished by providing a jam prevention means which shuts down a web handling device when a blockage occurs. In this invention, stripper fingers are mounted on a deflectible shaft near the conveyor surface of a web handling device and are ordinarily biased against the web conveyor surface. A blockage of a small portion of the web material at the stripper fingers presses against the stripper fingers and causes a deflection of the fingers and its shaft. Associated with the deflectible shaft is a means to detect a deflection of the shaft or stripper fingers. The detection means, either itself or in association with a device well known in the art, shuts down the web handling device when a deflection in the shaft or fingers is detected, thereby preventing a blockage from increasing to a jam and causing damage. Although the shut down means can be used with any web handling device, it is particularly useful in high-speed web presses and most particularly in the folding apparatus and accessories associated with high-speed web presses. The preferred embodiment described in this specification shows the jam prevention means used in connection with a high-speed paper folding apparatus associated with high-speed printing presses.

The deflectible shaft can be mounted in many ways known to the mechanical arts to permit movement in the stripper fingers such as the use of a spring loaded axle journaled in the sides of the device to permit rotative deflection. Alternately, the shaft supporting the stripper fingers can also be mounted in a spring biased or friction groove to permit lateral deflection when a blockage exerts a lateral pressure against the fingers.

BRIEF DESCRIPTION OF THE DRAWING

A better understanding of the present invention, as well as other objects and further features, may be had by reference to the detailed description of the invention as well as the accompanying drawings wherein:

FIG. 1 is a rear view of the folding area of a high-speed press showing the invention in place.

FIG. 2 is a schematic side view of the invention in place.

DESCRIPTION OF THE PREFERRED EMBODIMENT

The invention is illustrated in a modification of the delivery area of the folding apparatus on a Hantscho 25×38 inch offset web press. The invention is preferably located at the point where a web or a signature is stripped from a delivery cylinder.

In a large high-speed press, a web, which in this case is a continuous strip of paper is fed at high speeds through the printing rollers where three pages are printed across the width of the web on both sides of the web. The web is then fed to slitters which slit it into three ribbons which are in turn fed through a series of rollers which cause the ribbons to be aligned, one over another. The aligned ribbons are then cut and folded into signatures, each of which consists of twelve pages. The signature 1 is then fed as shown in FIG. 1 through a delivery apparatus by a series of rollers to a delivery cylinder 2. The signature is held against the cylinder 2 by a plurality of brass guides 3. As signature 1 moves around the cylinder 2, it encounters a plurality of stripper fingers 4 which remove signature 1 from delivery cylinder 2 and assist in feeding signature 1 to paddle wheel cylinder 5. Paddle wheel cylinder 5 in turn drops signature 1 onto conveyor 6 where it is removed from the press to a stacking area for later processing. The plurality of stripper fingers 4 are part of an assembly 7 mounted on shaft 8. Shaft 8 in the present invention is rotatably journaled into the side of the press as at 9. A spring 14 applies sufficient load on the shaft 8 to keep the assembly biased against the drum 2. Stripper finger 4 of this invention consists of three parts: a stripping portion 12 which is shaped and positioned in a manner well known for stripper fingers, an elongated moment arm portion 11 which assists in amplifying the deflection of stripping portion 12, and fulcrum portion 13 which is adapted to attach stripper finger 4 to shaft 8.

In operation, a blockage presses against one or more of stripper fingers 4 causing it to put pressure on shaft 8 overcoming the load of spring 14 causing the shaft 8 to rotate. Shaft 8 in a web handling device of the present invention is located further away from the guide way formed between guides 3 and stripping portions 12 of stripper fingers 4 than in a web handling device not utilizing the invention. The exact position of shaft 8 is controlled by the amount of movement needed to trip the particular shut off means used in the device. In the preferred embodiment a very slight movement of stripping portion 12 amplified by moment arm 11 will overcome the load of spring 14 and rotate shaft 8 approximately 1° to activate a detection means in the form of microswitch 10 or the like and immediately causes the press to shut down before a jam can form, thereby preventing damage to the press and allowing a pressman to remove the one or two errant signatures.

While the invention has been described in accordance with the preferred embodiment, it will be appreciated that various modifications can be made which will be apparent to one of skill in the art, and it is intended that such modifications will be covered by the claims appended thereto.

What is claimed is:

1. A jam prevention means for high speed web handling devices comprising a conveyor surface, stripper fingers biased towards said conveyor surface, a deflectible shaft on which said stripper fingers are mounted, means to detect a deflection of said shaft and shut down the web handling device thereby preventing a jam.

2. A jam prevention means according to claim 1 wherein the conveyor surface is a drum.

3. A jam prevention means according to claim 2 wherein the web handling device is a press.

4. A jam prevention means according to claim 2 wherein the deflectible shaft is rotatably mounted.

5. A jam prevention means according to claim 4 wherein the deflectible shaft is a spring loaded axle.

6. A jam prevention means according to claim 1 wherein the web handling device is the folding apparatus of a high-speed press.

7. A jam prevention means according to claim 6 wherein the deflectible shaft is rotatably mounted.

8. A jam prevention means according to claim 6 wherein the deflectible shaft is a spring loaded axle.

9. A jam prevention means according to claim 8 wherein the conveyor surface is a drum.

10. A jam prevention means according to claim 9 including guides which form a guide way with the stripper fingers.

* * * * *